US012593882B1

(12) United States Patent
Wilson

(10) Patent No.: US 12,593,882 B1
(45) Date of Patent: Apr. 7, 2026

(54) MULTIPURPOSE BIBS

(71) Applicant: Jason Christopher Wilson, Lake Oswego, OR (US)

(72) Inventor: Jason Christopher Wilson, Lake Oswego, OR (US)

( * ) Notice: Subject to any disclaimer, the term of this patent is extended or adjusted under 35 U.S.C. 154(b) by 0 days.

(21) Appl. No.: 19/173,564

(22) Filed: Apr. 8, 2025

Related U.S. Application Data

(60) Provisional application No. 63/631,344, filed on Apr. 8, 2024.

(51) Int. Cl.

| | |
|---|---|
| ***A41D 31/10*** | (2019.01) |
| ***A41B 13/10*** | (2006.01) |
| ***A41D 13/04*** | (2006.01) |
| ***A41D 15/00*** | (2006.01) |
| *A41D 31/18* | (2019.01) |
| *A44B 19/00* | (2006.01) |

(52) U.S. Cl.
CPC ..... *A41D 31/10* (2019.02); *A41B 13/10* (2013.01); *A41D 13/04* (2013.01); *A41D 15/00* (2013.01); *A41D 31/18* (2019.02); *A44B 19/00* (2013.01)

(58) Field of Classification Search
CPC ... A41B 13/10; A41B 13/103; A41B 2400/70; A45D 44/08; A41D 13/04; A41D 13/1245; A41D 2400/70; A41D 15/00; A41D 27/08; A47G 21/165; A41F 15/002
USPC ..... 2/66
See application file for complete search history.

(56) References Cited

U.S. PATENT DOCUMENTS

| | | | | |
|---|---|---|---|---|
| 211,426 | A * | 1/1879 | Rogers | A41D 1/02 2/93 |
| 2,170,703 | A * | 8/1939 | Waxman | A47D 15/006 D29/101.1 |
| 2,631,288 | A * | 3/1953 | Daust | A61J 9/0684 2/49.3 |
| 2,727,241 | A * | 12/1955 | Smith | A41D 13/081 D2/611 |
| 3,540,060 | A * | 11/1970 | Brown | A41B 13/103 D2/864 |
| 5,852,849 | A * | 12/1998 | Lansing | G09F 21/02 24/298 |
| 9,301,553 | B1 * | 4/2016 | Donovan | A41D 1/00 |
| 2002/0069446 | A1 * | 6/2002 | Pinckney | A41B 13/10 2/48 |

(Continued)

OTHER PUBLICATIONS p. 1 of "Fun and Fantasy" Stress Balls Category, 1001 Stress Balls, archived on Oct. 27, 2012, accessed from https://web.archive.org/web/20121027091934/http://www.1001stressballs.com/fun-and-fantasy/c-13 on Aug. 6, 2025 (Year: 2012).*

*Primary Examiner* — Patrick J. Lynch
*Assistant Examiner* — Brianna T. Duckworth
(74) *Attorney, Agent, or Firm* — Mohr Intellectual Property Law Solutions, PC

(57) ABSTRACT

Multipurpose bibs including multipurpose bibs including a body and a recess mounting point. The body includes an expanse of material adapted to overlie a torso of a person. The recess mounting point secures to the body. The recess mounting point defines a recess and includes flaps extending over the recess. The flaps are configured to retain a portion of a disposable bib selectively pressed into the recess. In some examples, the multipurpose bib includes rings affixed to the body, a tether coupled to the rings, and/or a hand accessory selectively coupled to the body.

14 Claims, 6 Drawing Sheets

(56) References Cited

U.S. PATENT DOCUMENTS

| | | | | |
|---|---|---|---|---|
| 2006/0225181 | A1* | 10/2006 | Rou | A47G 21/165<br>2/46 |
| 2011/0016599 | A1* | 1/2011 | Battick | A41B 13/10<br>2/243.1 |
| 2013/0042397 | A1* | 2/2013 | Halldin | A42B 3/125<br>2/411 |
| 2015/0313301 | A1* | 11/2015 | Shineman | A41D 13/0051<br>2/208 |
| 2019/0053549 | A1* | 2/2019 | Goldade | A41D 13/081 |
| 2022/0175061 | A1* | 6/2022 | Bill | A41D 31/305 |

* cited by examiner

MULTIPURPOSE BIBS

CROSS REFERENCE TO RELATED APPLICATIONS

This application claims priority to U.S. Application Ser. No. 63/631,344, filed on Apr. 8, 2024, which is hereby incorporated by reference for all purposes.

BACKGROUND

The present disclosure relates generally to bibs. In particular, bibs with multiple purposes and features are described.

Bibs are commonly used to protect people and clothing from exposure to messy, wet, or harmful environments. Dental cleanings and procedures are one example where bibs are commonly worn. Conventional, disposable bibs are worn by a patient to protect the patient's clothing from becoming wet or stained during dental procedures. Conventional, disposable bibs are also worn in a variety of other medical settings.

Bibs are used in numerous other contexts as well, such as to protect a person's body from harm. For example, a patient having an x-ray image taken will typically wear a bib made from lead or other x-ray blocking material. Bibs may be used to protect one's body from heat or sharp items, such as when working wood, welding, or machining parts.

Conventional bibs are not entirely satisfactory. Many conventional bibs are flimsy and disposable. The flimsy construction limits their ability to protect the wearer or the wearer's clothes. Further, disposable bibs can have an adverse environmental impact and can be more expensive than reusable bibs over time.

Some conventional bibs are reusable, but such bibs do not enable a disposable bib to be used when desired. It would be advantageous if a reusable bib existed that allowed for the selective use of disposable bibs when the utility of a disposable bib would be beneficial.

Another limitation of conventional bibs is that they do not help calm or comfort the wearer. Patients undergoing dental or other medical procedures are often anxious and stressed. It would be beneficial if a bib could help to reduce stress and anxiety for the person wearing the bib.

Conventional bibs tend to not adequately address the hands of the wearer. Instead, conventional bibs tend to cover only the wearer's torso. Bibs that include pockets address a person's hands to some extent, but the pockets are typically fixed components of the bib and make the bib larger and bulkier than may be needed for a given situation. It would be desirable to have a bib that was selectively configurable to have a place for a person's hands when needed and to be more streamlined without hand features when such features were not needed.

Thus, there exists a need for bibs that improve upon and advance the design of known bibs. Examples of new and useful multipurpose bibs relevant to the needs existing in the field are discussed below.

SUMMARY

The present disclosure is directed to multipurpose bibs including a body and a recess mounting point. The body includes an expanse of material adapted to overlie a torso of a person.

The recess mounting point secures to the body. The recess mounting point defines a recess and includes flaps extending over the recess. The flaps are configured to retain a portion of a disposable bib selectively pressed into the recess.

In some examples, the multipurpose bib includes rings affixed to the body, a tether coupled to the rings, and/or a hand accessory selectively coupled to the body.

DETAILED DESCRIPTION

Figure 1:
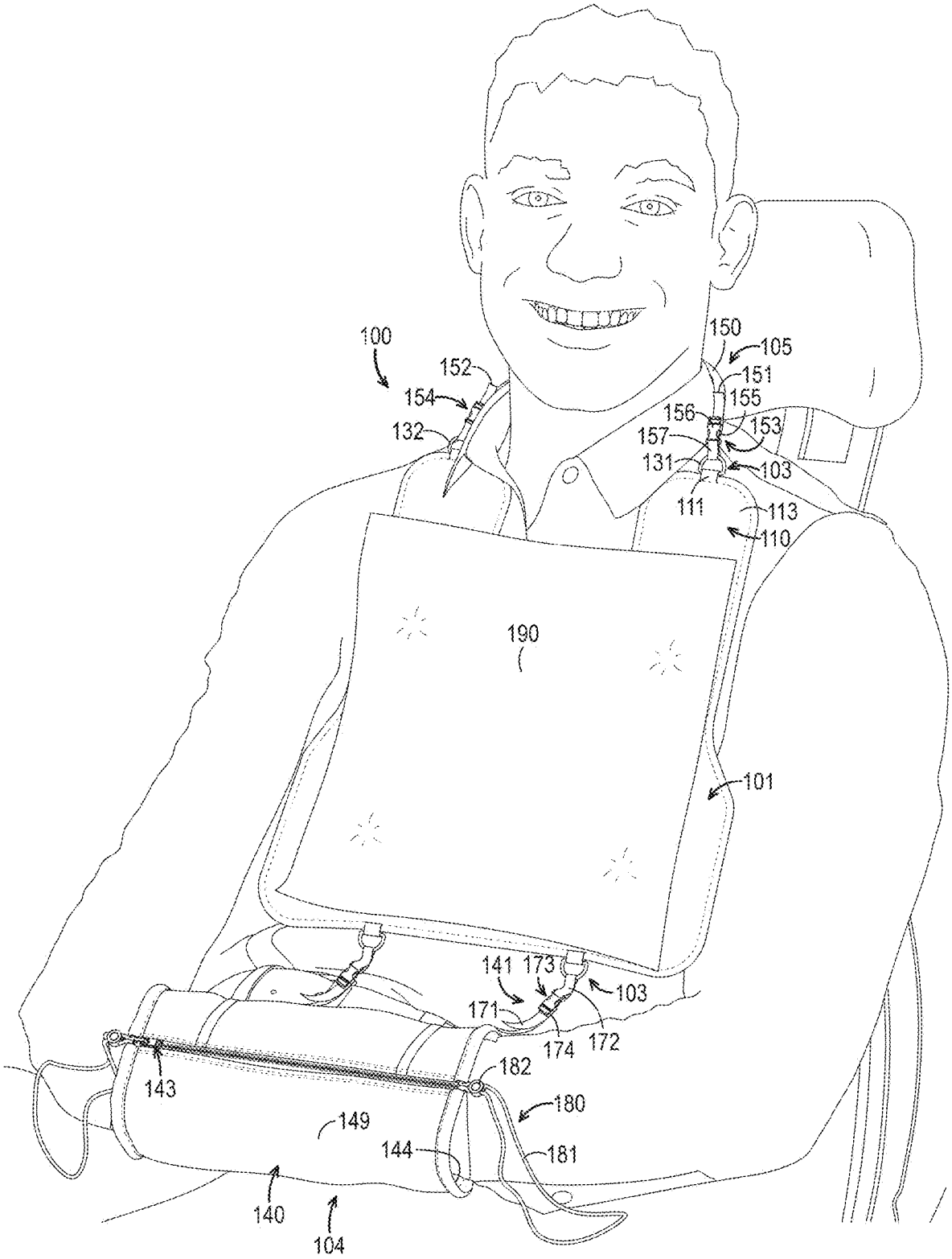
FIG. 1 is a perspective view of a first example of a multipurpose bib worn by a person with his hands inside a hand accessory of the multipurpose bib and a disposable bib attached to the front of the bib.

The disclosed multipurpose bibs will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various multipurpose bibs are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Contextual Details

Ancillary features relevant to the multipurpose bibs described herein will first be described to provide context and to aid discussing the multipurpose bibs.

Disposable Bibs

The multipurpose bibs disclosed herein are designed to selectively support disposable bibs when disposable bibs would be useful. For example, a disposable bib may be convenient when the bib may be exposed to blood or other bodily fluids or to caustic, staining, or other undesirable chemicals. The novel multipurpose bibs described herein may utilize a disposable bib as a protective layer to reduce cleaning time and effort and to protect the multipurpose bib.

One suitable example of a conventional disposable bib, disposable bib 190, is shown in FIG. 1. Disposable bib 190 is a multiple ply, waterproof sheet material. Disposable bib 190 includes two plies of paper and one ply of a polymer material, but may be formed from different materials or with different numbers of plies in other examples. Any currently known or later developed composition, type, size, and shape of disposable bib may be used with the multipurpose bibs described in this document.

Multipurpose Bibs

With reference to the figures, multipurpose bibs will now be described. The multipurpose bibs discussed herein function to protect a person wearing the multipurpose bib and the person's clothing from exposure to wet, dirty, and/or harmful things in proximity to the person. The multipurpose bibs also function to reduce stress and anxiety in the person wearing the multipurpose bib.

The reader will appreciate from the figures and description below that the presently disclosed multipurpose bibs address many of the shortcomings of conventional bibs. For example, the novel multipurpose bibs described herein are not flimsy and disposable, but rather are substantially constructed and reusable. The sturdy construction of the novel multipurpose bibs enhances their ability to protect the wearer and the wearer's clothes. Further, the reusable nature of the novel multipurpose bibs reduces their environmental impact and cost over time.

Advantageously, the novel multipurpose bibs are configured to allow for disposable bibs to be selectively used when the utility of a disposable bib would be beneficial. The novel multipurpose bibs provide quick and easy means to attach disposable bibs when needed.

Importantly, the novel multipurpose bibs help calm and comfort the wearer. With particular application for patients experiencing stress and anxiety while undergoing dental or other medical procedures, the novel multipurpose bibs help to reduce stress and anxiety for the person wearing the bib.

In contrast to conventional bibs, the novel multipurpose bibs address the hands of the wearer and are not limited to covering only the wearer's torso. The novel multipurpose bibs selectively accommodate a wearer's hands without the extra size and bulk of fixed pockets. Desirably, the novel multipurpose bibs are selectively configurable to provide a place to cover a person's hands when needed and to have the hand cover removable when covering the hand is not needed. As discussed in more detail below, the hand accessory of the novel multipurpose bibs includes features to reduce stress and anxiety for the wearer.

Multipurpose Bib Embodiment One

With reference to FIGS. 1-6, a first example of a multipurpose bib, multipurpose bib 100, will now be described. As shown in FIGS. 1-4, multipurpose bib 100 includes a body 101, recess mounting points 102, projection mounting points 103, a hand accessory 104, and a tether 105. The components of multipurpose bib 100 are described further below.

In some examples, the multipurpose bib does not include one or more features included in multipurpose bib 100. For example, some multipurpose bib examples do not include a hand accessory, projection mounting points, and/or straps. In certain examples, the multipurpose bib includes additional or alternative features.

Body

Body 101 functions to protect the person wearing multipurpose bib 100 and the person's clothing from debris or harmful things that may come in close proximity to the person. Body 101 also supports recess mounting points 102, projection mounting points 103, and straps 105. Body 101 further functions to reduce the wearer's anxiety and stress and to provide comfort.

Body 101 is configured to be worn over a person's chest. In other examples, the body may be configured to be worn over a person's back, arm or arms, and leg or legs. In certain examples, the body is configured to be worn over a person's head and/or face.

The reader can see in FIGS. 1-4 that body 101 is shaped to roughly correspond with the size and shape of a person's torso, including a neck recess, shoulder portions, a narrower upper torso portion, and a wider lower torso portion. However, the size and shape of the body of the multipurpose bib may vary considerably in different examples. For example, the body may be sized for different size people, such as adults versus children, men versus women, or larger versus smaller individuals. The shape of the body may be selected to correspond with the region of the human body the multipurpose bib is intended to cover.

It has been observed that increasing the weight of the body of the multipurpose bib can provide a calming and comforting effect when worn by a person. Body 101 is weighted to reduce stress and anxiety and to help the wearer be calm and comfortable. Other examples of the body do not include added weight for anxiety reducing purposes.

In the present example, body 101 is weighted with internal fill material selected to increase the weight of body 101 to facilitate anxiety reduction in the wearer. In other examples, the body is formed from a sufficiently heavy material that internal fill material is not needed to achieve the desired weight for the body.

The amount of increased weight for the body is selected to be effective to reduce anxiety when worn. Suitable weight ranges are 1-20 pounds. A more preferred range is 2-12 pounds. For adults, most preferred weight ranges are 4-7 pounds for women, 5-8 pounds for men, and 5-7 pounds for unisex applications. The weight selected for the body may be any weight currently known or later determined to provide anxiety reducing benefits.

In the example shown in FIGS. 1-4, body 101 includes an expanse of material 110 and loops 111. The body may include additional or alternative components in other examples. The components of body 101 are described further in the sections below.

Material Expanse

Material expanse 110 is configured to cover a person's torso. Material expanse 110 includes an outer surface 113.

Outer surface 113 is configured to enable easily wiping away liquids and other debris. In particular, outer surface 113 is non-porous to restrict liquids from penetrating outer surface 113. Outer surface 113 and material expanse 110 as a whole are selected to be durable, easy to clean, and comfortable for the wearer. The outer surface of the body may display a design, which may be functional and/or decorative.

Body 101 secures to a user in a positon over the user's chest with tether 105 and projection mounting points 103. Tether 105 extends behind a user's neck to support body 101 on a user's chest. Tether 105 selectively couples to body 101 to selectively maintain body 101 on a user's chest and to selectively move body 101 away from a user's chest.

Tether 105 incudes a tether member 150 with a first terminal end 151 and a second terminal end 152 opposite the first terminal end. Tether 105 further includes a first clip 153 disposed at first terminal end 151 and a second clip 154 disposed at second terminal end 152. Clips 153 and 154 selectively couple to projection mounting points 103 pivotally linked to body 101 via loops 111.

In particular, clips 153 and 154 selectively couple to projection mounting points 103 at shoulder portions of body 101. As shown in FIGS. 1-4, first clip 153 selectively couples to a first ring 131 disposed at a left shoulder portions of body 101, and second clip 154 selectively couples to a second ring 132 disposed at a right shoulder portions of body 101.

Loops

Loops 111 are fabric members with opposite ends sewn to material expanse 110. Loops 111 are sewn to material expanse 110 where projection mounting points 103 are disposed. Loops 111 receive projection mounting points 103 and enable projection mounting points 103 to pivot within loops 111. Loops 111 and the rings of projection mounting points 103 collectively define hinge rings.

Recess Mounting Points

Recess mounting points 102 enable selectively coupling disposable bibs to body 101. By being recessed, recess mounting points 102 do not interfere with the operation of multipurpose bib 100 when they are not used to selectively couple a disposable bib.

Figure 2:
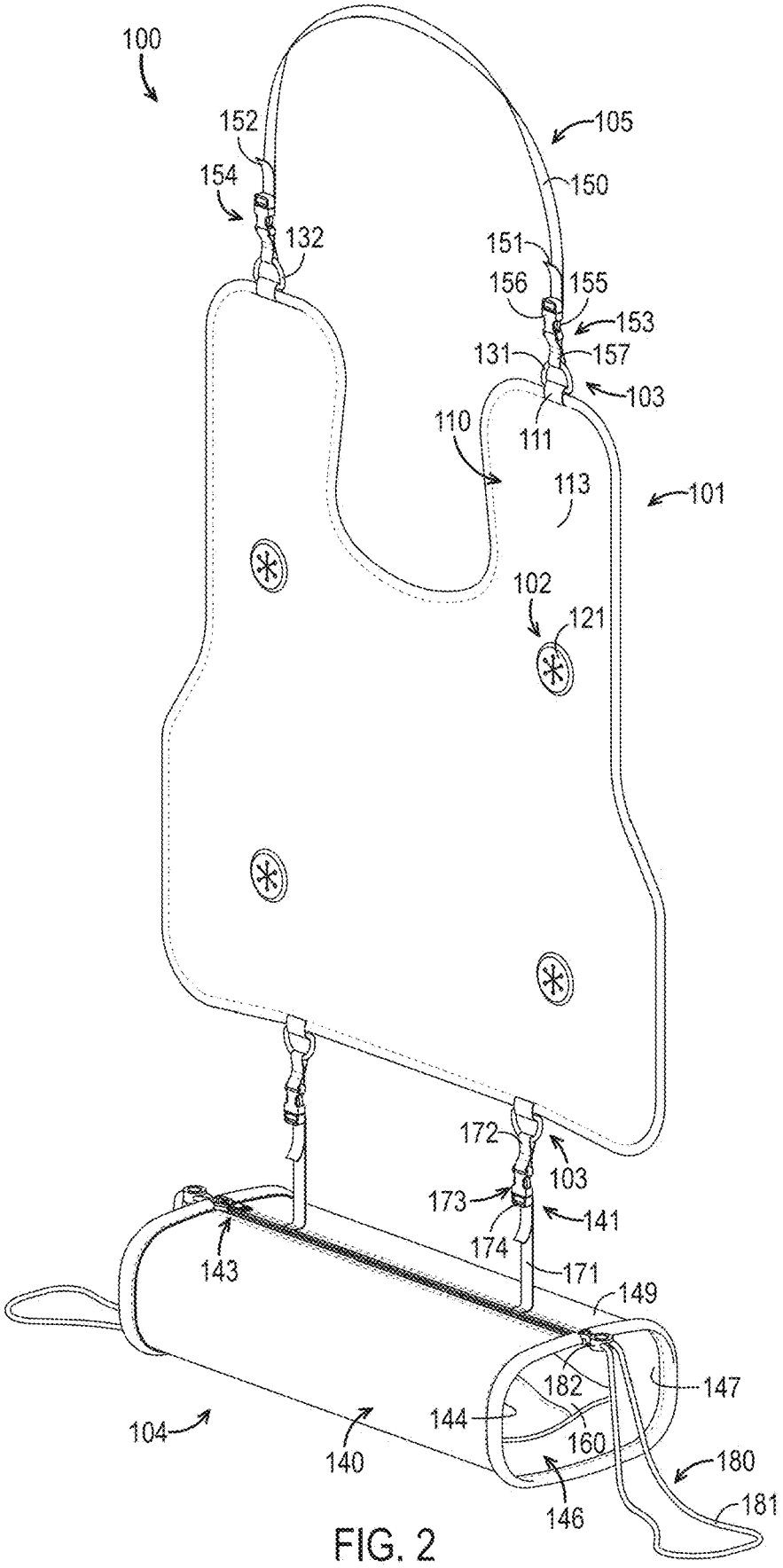
FIG. 2 is perspective view of the multipurpose bib shown in FIG. 1 without a disposable bib attached to it.
Figure 3:
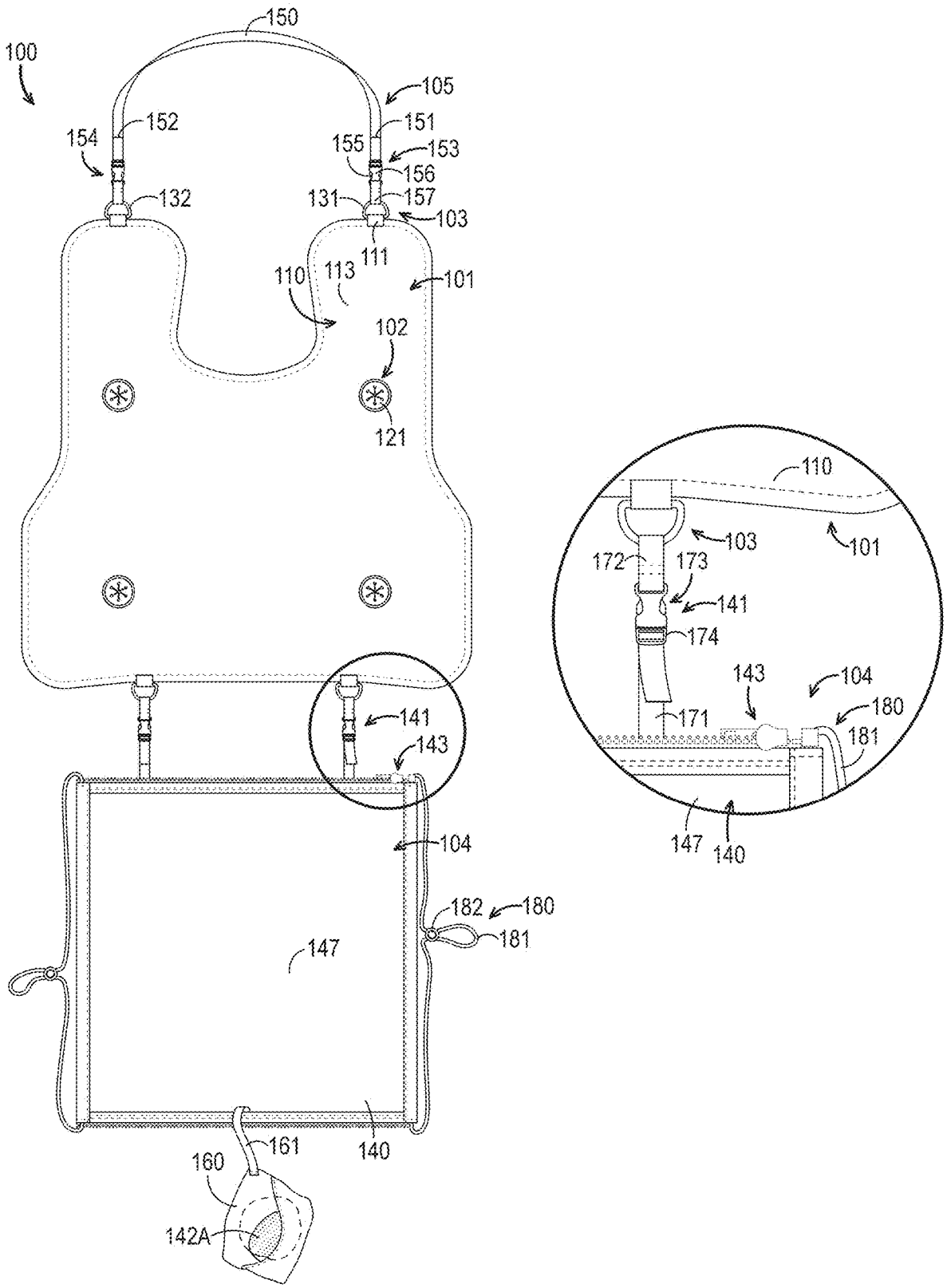
FIG. 3 is a front elevation view of the multipurpose bib shown in FIG. 1 with a pocket of the hand accessory unzipped and opened to reveal a pouch secured inside the pocket.
Figure 4:
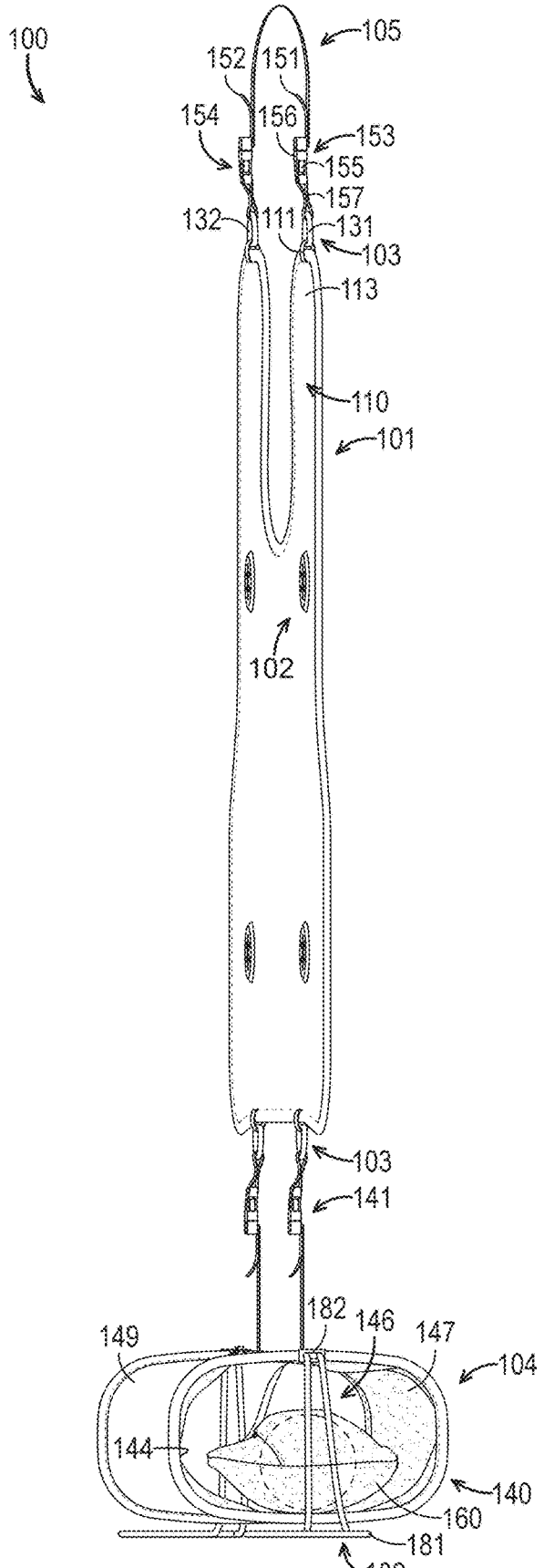
FIG. 4 is a side elevation view of the multipurpose bib shown in FIG. 1.

As shown in FIGS. 2-4, four recess mounting points 102 are disposed on the front of body 102. However, the number of recess mounting points may be greater or fewer as needed to effectively secure a disposable bib. The reader should understand that the recess mounting points may additionally or alternatively be disposed on the back of the body.

One suitable configuration of recess mounting points 102 is shown in FIGS. 2-4. Recess mounting points 102 define a recess and include a plurality of flaps 121.

Flaps 121 are disposed radially around an outer circumference of the recess. Flaps 121 are secured to the outer circumference and extend towards a center of the recess. Flaps 121 are pliable and taper towards the center of the recess.

As shown in FIG. 1, disposable bib 190 can be selectively pressed into the center of the recess where the narrow ends of flaps 121 converge. Flaps 121 cooperate to retain disposable bib 190 or other sheet material in the recess until disposable bib 190 is selectively removed.

Projection Mounting Points

Projection mounting points 103 function to selectively secure hand accessory 104 or other accessories to body 101. With reference to FIGS. 1-4, projection mounting points 103 are configured to link with couplers 141 of hand accessory 104. Couplers 141 selectively clip to projection mounting points 103 to enable pocket 140 of hand accessory 104 to hang from projection mounting points 103. The projection mounting points are an optional feature not present in every example of the multipurpose bibs discussed herein.

In the example shown in FIGS. 1-4, projection mounting points 103 are in the form of rings, including first ring 131 and second ring 132. The rings are pivotally affixed to body 101 to define a hinge rings. The rings pivotally attach to body 101 by extending through loops 111

However, in other examples, the projection mounting points are projections other than rings or hinge rings, such as buttons or snaps. In some examples, alternative forms of mounting points, not necessarily projections, such as hook-and-loop fasteners or magnets, are included in the multipurpose bib to selectively secure accessories.

As shown in FIGS. 1-4, two projection mounting points 103 are disposed on a top side of body 101 and two project mounting points 103 are disposed on a bottom side of body 101. The projection mounting points may additionally or alternatively be mounted to a front side, a rear side, and/or on side edges of the body.

In the present example, multipurpose bib 100 includes four projection mounting points 103. However, other multipurpose bib examples include fewer projection mounting points while some examples include five or more projection mounting points. Some examples do not include any projection mounting points.

Hand Accessory

Hand accessory 104 serves multiple functions. One function is to keep the wearer's hands warm. Another function is to protect the wearer's hands from debris or harmful things that may be present.

A further function of hand accessory 104 is to keep the wearer's hands in a safe position to avoid the wearer's hands interfering with activity around the wearer, such as a dental procedure. An additional function is to reduce stress and anxiety for the wearer by providing the user with a stress relieving activity to undertake with his or her hands.

In the example shown in FIGS. 1-5, hand accessory 104 includes a pocket 140, couplers 141, a stress reliever 142A, a pouch 160, and a tensioner 180. The components of hand accessory 104 are described in the sections below.

The hand accessory may include fewer components than hand accessory 104 in other examples, such as not including a stress reliever, a pouch, and/or a tensioner. In some examples, the hand accessory includes additional or alternative components than depicted in FIGS. 1-5, such as additional or alternative stress relievers.

Figure 6:
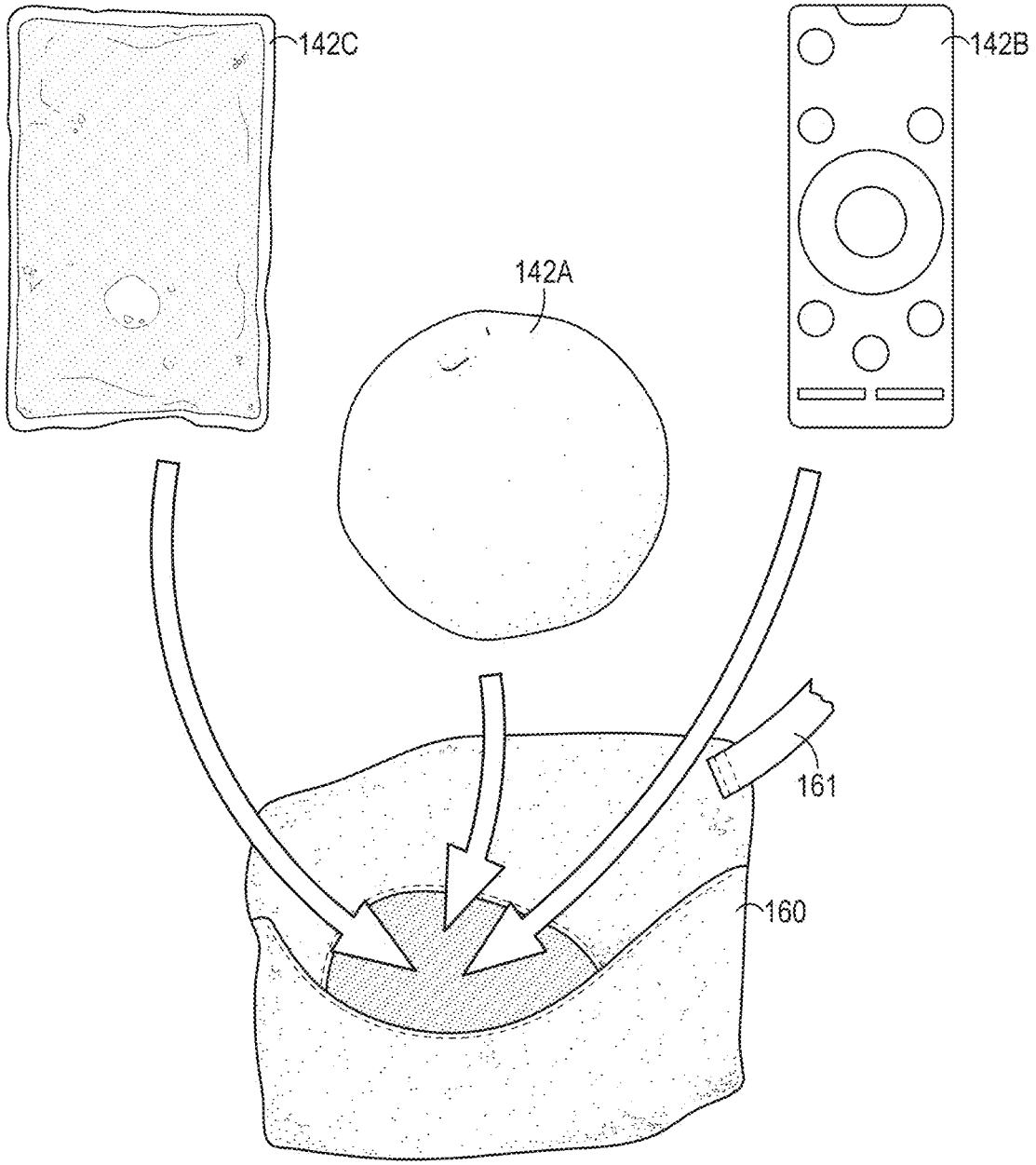
FIG. 6 is a view of stress relievers that may be included in the hand accessory of the multipurpose bib.

For example, as shown in FIG. 6, the hand accessory may include stress relievers in the form of a stress ball 142A, a device controller 142B, or a thermal gel pack 142C. A wide variety of other types of stress relievers are contemplated as well.

FIGS. 1-4 demonstrate that hand accessory 104 is selectively coupled to body 101 in a position convenient for a person wearing multipurpose bib 100 to place his or her hands in hand accessory 104. In particular, hand accessory 104 selectively couples to body 101 proximate a waist portion of body 101. Couplers 141 selectively couple to projection mounting points 103 disposed at the waist portion of body 101 to secure hand accessory 104 to body 101.

In some examples, the hand accessory is used independent of the multipurpose bib. It has been observed that the hand accessory provides anxiety and stress reducing benefits whether or not it is used with the body of the multipurpose bib. Standalone hand accessories may or may not include couplers to selectively attach the hand accessory to the body of the multipurpose bib.

The hand accessory may be weighted in standalone applications or when included as a component of a multipurpose bib. The hand accessory being weighted imparts calming pressure on a person's hands inside the hand accessory. The calming pressure on the wearer's hands functions to reduce stress and anxiety for the wearer.

Pocket

Pocket 140 functions to selectively receive a wearer's hands. Receiving a wearer's hands serves to keep them warm. Receiving the wearer's hands can also beneficially keep the user's hands in a known, safe position. The pocket may be weighted, which may serve to reduce anxiety and stress for a person with his or her hands inside the pocket.

Pocket 140 contains stress reliever 142A removeably disposed inside pouch 160. Pocket 140 provides space for a wearer to interact with stress reliever 142A within a lumen 146 of pocket 140. Further, pocket 140 supports couplers 141 sewn to pocket 140.

In the example shown in FIGS. 1-5, pocket 140 is a fabric member that may selectively adopt the shape of a tube or may selectively adopt a planar configuration. As shown in FIGS. 1-3, pocket 140 includes a zipper closure 143 to selectively open and close pocket 140 to enable pocket 140 to adopt the tube configuration and the planar configuration, respectively. As apparent in FIGS. 1-3, zipper closure 143 extends longitudinally along pocket 140.

In the planar configuration of pocket 140 shown in FIG. 3, pocket 140 may lay flat and zipper closure 143 is unzipped. The planar configuration facilitates drying lumen 146 by increasing the exposure of an inner layer 147 of pocket 140 to surrounding air. In the tube configuration of pocket 140 shown in FIGS. 1, 2, and 4, pocket 140 defines a tube shape with a lumen 146 and zipper closure 143 is closed.

As depicted in FIGS. 1, 2, and 4, pocket 140 defines openings 144 on opposite longitudinal ends of pocket 140. As shown in FIG. 1, a person wearing multipurpose bib 100 can selectively insert hands into lumen 146 through openings 144. Stress reliever 142A and pouch 160 are disposed in lumen 146.

Figure 5:
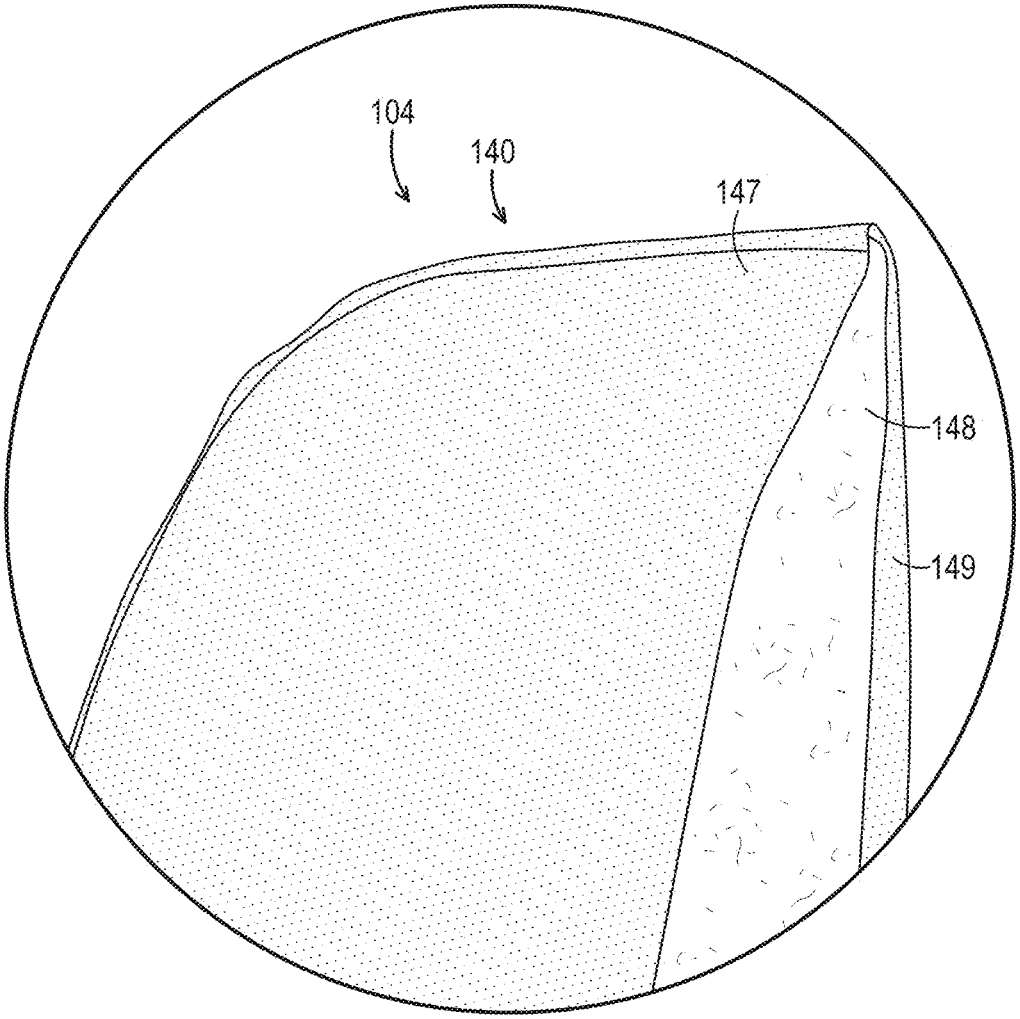
FIG. 5 is a view of an intermediate layer of a pocket of the hand accessory of the multipurpose bib shown in FIG. 1.

As shown in FIG. 5, pocket 140 includes an inner layer 147, an intermediate layer 148, and an outer layer 149. Inner layer 147 faces lumen 146 when pocket 140 is in the tube configuration. Intermediate layer 148 is disposed between inner layer 147 and outer layer 149. Outer layer 149 is separated from lumen 146 by inner layer 147 and intermediate layer 148.

In the present example, inner layer 147 and outer layer 149 are comprised of fabric. The fabric is selected to be soft to the touch, pliable, and to have insulative properties.

Intermediate layer 148 is sufficiently rigid to maintain pocket 140 in the shape of a tube and to keep lumen 146 from collapsing. Intermediate layer 148 is comprised of an elastic material to selectively modify the shape of pocket 140. The intermediate layer may be any currently known or later developed material with rigidity and elasticity properties suitable for the pocket.

Intermediate layer 148 is coupled to tensioner 180 and can be selectively tensioned by tensioner 180 to correspondingly and elastically modify the shape of pocket 140. For example, a user pulling on a drawstring 181 of tensioner 180 and fixing the effective length of drawstring 181 with a cleat 182 tensions intermediate layer 148 and causes pocket 140 to contract and cinch lumen 146 to a narrower diameter. A user releasing tension in intermediate layer 148 by activating cleat 182 to allow drawstring 181 to lengthen causes pocket 140 to elastically expand and the diameter of lumen 146 to increase.

As shown in FIGS. 3 and 4, pocket 140 receives stress reliever 142A inside lumen 146 through opening 144. The wearer can interact with stress reliever 142A inside pocket 140 to reduce stress and/or pass time. As shown in FIGS. 2, 3, 4, and 6, stress reliever 142A is removably contained within a pouch 160 disposed within lumen 146 and secured to pocket 140 with a strap 161.

Couplers

Couplers 141 function to selectively couple hand accessory 104 to body 101 via projection mounting points 103. The length of couplers 141 may be selectively adjusted to enable pocket 140 to hang a desired distance from body 101.

In the example shown in FIGS. 1-4, hand accessory 104 includes two couplers 141. However, the hand accessory may include a single coupler or more than two couplers in other examples. In some examples, the hand accessory does not include any couplers and the pocket is a standalone feature untethered to the body of multipurpose bib.

As shown in FIGS. 1-4, each coupler 141 includes a first linking strap 171, a second linking strap 172, and a clip 173. First linking strap 171 is coupled to pocket 140 and second linking strap 172 is coupled to mounting point 103. Clip 173 selectively couples first linking strap 171 to second linking strap 172 with a male-female interlock; thereby linking pocket 140 to body 101. The effective length of first linking strap 171 may be adjusted by routing first linking strap 171 through a buckle 174 included in clip 173.

In some examples, the coupler includes a single strap connected to a hook-clip. The hook-clip selectively couples directly to the mounting point rings of the body of the multipurpose bib. The hook-clip may have a pivoting gate member biased to close the hook opening unless manually pivoted open to insert or remove a mounting point ring into the hook-clip.

Optionally, the strap may link to the hook-clip via a buckle fixed to the hook-clip. The strap may extend through the buckle, loop back on to itself, and selectively secure to itself with a band or cleat. The effective length of the strap may be adjusted by selectively extending more or less of the strap through the buckle before securing the strap to itself to fix the length of the strap between the pocket of the hand accessory and the buckle.

Other types of couplers are contemplated. For example, the couplers may be a hook-and-loop fastener, a magnet, or loops of material. The coupler may be any currently known or later developed type of coupler suitable for coupling the pocket to the body.

Stress Reliever

Stress reliever 142A serves to reduce stress and anxiety for the wearer by providing the wearer with something to manipulate with his or her hands. Having something to manipulate with one's hands allows one to focus on something other than a potentially stressful event or activity, such as a dental procedure.

In the present example, stress reliever 142A is a stress ball configured to be repeatedly squeezed and manipulated. The wearer may squeeze, rotate, lift, or toss stress reliever 142A within pocket 140 to reduce stress and anxiety. As shown in FIG. 6, the hand accessory may include additional or alternative stress relievers in the form of a device controller 142B or a thermal gel pack 142C. A wide variety of other types of stress relievers are contemplated as well.

Device controller 142B controls a media player, but could control any electronic device, such as a massage chair. Thermal gel pack 142C is configured to be squeezed and manipulated to displace the gel within the pack, which reduces stress and anxiety. Thermal gel pack 142C may be heated or cooled to correspondingly warm or cool a user's hands within pocket 140.

The stress reliever may be any currently known or later developed type of object or device conducive to reducing stress and anxiety. For example, the stress reliever could be a plush animal or toy, worry beads, a media player controller, a massage chair controller, and a wide variety of other objects and/or devices. Some hand accessory examples do not include a stress reliever and instead serve primarily to keep the wearer's hands warm and in a known position.

Pouch

Pouch 160 functions to secure stress reliever 142A within lumen 146 of pocket 140. In particular, pouch 160 enables stress relievers, such as stress relievers 142A, 142B, and 142C, shown in FIG. 6 to be interchangeably stored within lumen 146. Further, pouch 160 facilitates storing multiple stress relievers within lumen 146.

As shown in FIGS. 2-4 and 6, pouch 160 is configured to selectively store a stress reliever while allowing a user to selectively access the stress reliever inside lumen 146. Pouch 160 is comprised of a pliable material, but other pouch examples may be formed from rigid materials. The size and shape of the pouch may vary in different examples.

As demonstrated in FIG. 3, pouch 160 includes a strap 161 that links pouch 160 to pocket 140 inside lumen 146. In the present example, strap 161 is sewn to pocket 140 inside lumen 146, but may couple to the pocket by any suitable means, such as hook-and-loop fasteners, magnetic couplers, adhesives, or mechanical fasteners. In some examples, the pouch is not coupled to the pocket and simply resides within the lumen of the pocket.

Tether

Tether 105 functions to secure body 101 to a person wearing multipurpose bib 100. Tether 105 extends behind a user's neck and couples to projection mounting points 103 secured to body 101 at shoulder portions of body 101 to support body 101 over a person's chest.

Tether 105 selectively couples to projection mounting points 103 pivotally linked to body 101. In particular, tether 105 selectively couples to two projection mounting points 103 at opposite shoulder portions of body 101. As shown in FIGS. 1-4, a first clip 153 of tether 105 selectively couples to a first ring 131 disposed at a left shoulder portions of body 101, and second clip 154 selectively couples to a second ring 132 disposed at a right shoulder portions of body 101.

In the present example, tether 105 includes a tether member 150, a first clip 153, and a second clip 154. Tether member 150 includes a first terminal end 151 and a second terminal end 152 opposite the first terminal end. First clip 153 is disposed at first terminal end 151, and second clip 154 is disposed at second terminal end 152.

Tether member 150 is formed from a strap material. The tether member may be formed from any currently known or later developed elongate tension bearing member. First clip 153 and second clip 154 are configured the same, so the components of just first clip 153 will be described with the understanding that the description applies to second clip 154 as well.

First clip 153 includes a male member 155, a female member 156, and a link strap 157. Male member 155 is coupled to tether member 150 and selectively couples to female member 156 via a male-female interlock or detent arrangement. Link strap 157 couples to female member 156 and to projection mounting point 103. When male member 155 couples to female member 156, tether 105 couples to body 101.

In some examples, the tether includes a tether member with alligator clips (also known as bib clips) on each terminal end of the tether member. The alligator clips may selectively couple directly to the mounting point rings on the shoulder portions of the body of the multipurpose bib. In certain examples, the alligator clips are pivotally or movably mounted to the ends of the tether member to allow the orientation of the alligator clips relative to the tether member to be adjusted.

In other examples, the clips include a magnet to magnetically couple the tether to the projection mounting points. In some examples, the multipurpose bib includes two tethers that magnetically couple together behind a person's neck to secure the body in position over the person's chest. Magnetically coupling tethers together has been observed to be a convenient and fast method of securing the multipurpose bib to a person.

Any suitable type of magnet may be included in the tether. The magnet may be covered by an outer layer of material to contain and protect the magnet. In some examples, the magnet is exposed and secured directly to the tether member.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A multipurpose bib, comprising:

a body including an expanse of material adapted to overlie a torso of a person;

a recess mounting point secured to the body, the recess mounting point defining a recess and including flaps extending over the recess, the flaps being configured to retain a portion of a disposable bib selectively pressed into the recess;

a first ring affixed to the body at a left shoulder portion;

a second ring spaced from the first ring and affixed to the body at a right shoulder portion;

a first link strap coupled to the first ring;

a second link strap coupled to the second ring;

a tether including:

a first terminal end;

a second terminal end opposite the first terminal end;

a first clip configured to selectively couple the tether to the first link strap, the first clip including:

a first male member coupled to the first terminal end of the tether; and a first female member coupled to the first link strap, the first female member and the first male member configured to selectively couple by inserting the first male member into the first female member; and a second clip configured to selectively couple the tether to the second link strap, the second clip including:

a second male member coupled to the second terminal end of the tether; and a second female member coupled to the second link strap, the second female member and the second male member configured to selectively couple by inserting the second male member into the second female member.

2. The multipurpose bib of claim 1, wherein the body weighs between 1 and 20 pounds.

3. The multipurpose bib of claim 1, wherein:

the body includes an outer surface; and the outer surface is non-porous to restrict liquids from penetrating the outer surface.

4. The multipurpose bib of claim 1, wherein the first ring is pivotally affixed to the body to define a hinge ring.

5. The multipurpose bib of claim 1, wherein the tether extends around a back of a neck of a person wearing the multipurpose bib when the first clip selectively couples the tether to the first link strap and the second clip selectively couples the tether to the second link strap.

6. A multipurpose bib, comprising:

a body including an expanse of material adapted to overlie a torso of a person;

a recess mounting point secured to the body, the recess mounting point defining a recess and including flaps extending over the recess, the flaps being configured to retain a portion of a disposable bib selectively pressed into the recess;

a ring pivotally affixed to the body at a waist portion of the body;

a first link strap coupled to the ring;

a hand accessory;

a second link strap coupled to the hand accessory; and a clip configured to selectively couple the first link strap to the second link strap, the clip including:

a first clip portion coupled to the first link strap; and a second clip portion coupled to the second link strap, the second clip portion and the first clip portion configured to selectively clip together to selectively couple the first link strap to the second link strap.

7. The multipurpose bib of claim 6, wherein:

the hand accessory defines a pocket in the shape of a tube with a lumen; and the pocket is configured to receive hands of a person wearing the multipurpose bib within the lumen.

8. The multipurpose bib of claim 7, wherein:

the pocket includes an inner layer proximate the lumen; and the inner layer is comprised of fabric.

9. The multipurpose bib of claim 8, wherein:

the pocket includes an outer layer separated from the lumen by the inner layer; and the pocket has an intermediate layer disposed between the inner layer and the outer layer.

10. The multipurpose bib of claim 9, wherein the intermediate layer is comprised of an elastic material.

11. The multipurpose bib of claim 7, wherein the hand accessory includes a stress reliever disposed within the lumen.

12. The multipurpose bib of claim 11, wherein:

the hand accessory includes a pouch secured to the pocket within the lumen; and the stress reliever is removably disposed within the pouch.

13. The multipurpose bib of claim 11, wherein the stress reliever is a ball.

14. The multipurpose bib of claim 7, wherein the pocket includes a zipper extending longitudinally along the pocket, the zipper configured to selectively open the pocket to expose the lumen to facilitate drying the lumen.

* * * * *